US007071633B2

(12) United States Patent
Gallagher et al.

(10) Patent No.: US 7,071,633 B2
(45) Date of Patent: Jul. 4, 2006

(54) BURST PULSE CIRCUIT FOR SIGNAL LIGHTS AND METHOD

(75) Inventors: Shawn Gallagher, Harrisburg, PA (US); Matthew Johnson, Shermansdale, PA (US); Timothy Zink, Mechanicsburg, PA (US)

(73) Assignee: Trafcon Industries, Inc., Mechanicsburg, PA (US)

( * ) Notice: Subject to any disclaimer, the term of this patent is extended or adjusted under 35 U.S.C. 154(b) by 458 days.

(21) Appl. No.: 10/617,280

(22) Filed: Jul. 10, 2003

(65) Prior Publication Data

US 2005/0007304 A1 Jan. 13, 2005

(51) Int. Cl.
*H05B 37/00* (2006.01)

(52) U.S. Cl. ..... 315/291; 315/224

(58) Field of Classification Search ..... 315/185 S, 315/185 R, 200 R, 209 R, 200 A, 291, 294, 315/312, 224, 219
See application file for complete search history.

(56) References Cited

U.S. PATENT DOCUMENTS

| | | | | |
|---|---|---|---|---|
| 4,634,928 | A | 1/1987 | Figueroa et al. | 313/499 |
| 4,827,245 | A | 5/1989 | Lipman | 340/321 |
| 5,010,412 | A | 4/1991 | Garriss | 348/371 |
| 5,057,820 | A | 10/1991 | Markson et al. | 340/600 |
| 5,313,187 | A | 5/1994 | Choi et al. | 340/331 |
| 5,317,307 | A | 5/1994 | Thomas, Jr. | 340/815.45 |
| 5,450,301 | A | 9/1995 | Waltz et al. | 362/231 |
| 5,452,188 | A | 9/1995 | Green et al. | 362/493 |
| 5,785,410 | A | 7/1998 | Branson, Sr. | 362/153.1 |
| 5,806,965 | A | 9/1998 | Deese | 362/249 |
| 5,815,018 | A | 9/1998 | Soborski | 327/172 |
| 5,890,794 | A | 4/1999 | Abtahi et al. | 362/294 |
| 5,990,802 | A | 11/1999 | Maskeny | 340/815.45 |
| 6,255,786 | B1 * | 7/2001 | Yen | 315/291 |
| 6,414,437 | B1 * | 7/2002 | Diez et al. | 315/77 |
| 6,461,008 | B1 | 10/2002 | Pederson | 362/35 |
| 6,483,254 | B1 * | 11/2002 | Vo et al. | 315/241 S |
| 6,504,487 | B1 | 1/2003 | Pederson | 340/815.45 |
| 6,527,422 | B1 * | 3/2003 | Hutchison | 362/373 |
| 6,596,977 | B1 * | 7/2003 | Muthu et al. | 250/205 |
| 6,801,003 | B1 * | 10/2004 | Schanberger et al. | 315/291 |
| 6,836,079 | B1 * | 12/2004 | Hong | 315/291 |
| 6,867,757 | B1 * | 3/2005 | Nakamura | 345/83 |
| 6,904,348 | B1 * | 6/2005 | Drummond et al. | 701/49 |
| 6,950,220 | B1 * | 9/2005 | Abramson et al. | 359/265 |
| 6,963,175 | B1 * | 11/2005 | Archenhold et al. | 315/291 |
| 6,969,843 | B1 * | 11/2005 | Beach et al. | 250/228 |

OTHER PUBLICATIONS

*555 Timer Tutorial*, Tony van Roon, 1995, pp. 1-27.

* cited by examiner

*Primary Examiner*—Wilson Lee
(74) *Attorney, Agent, or Firm*—Duane Morris LLP

(57) ABSTRACT

A circuit is provided for over-driving a super-luminescent light emitting diode having a maximum forward continuous current rating. A power supply provides a pulse width modulated signal to an analog memory connected to the power supply and a pulse generator. The pulse generator includes a window comparator engaged with the analog memory, and is responsive to a portion of the pulse width modulated signal. A power driver that is controlled by the output of the pulse generator, is operably connected with the super-luminescent light emitting diode and with the power supply so as to energize the super-luminescent light emitting diode with a current that is above the maximum forward continuous current rating by between two and ten times that rated current. A signal is also provided along with a method of over-driving a super-luminescent light emitting diode.

36 Claims, 9 Drawing Sheets

BURST PULSE CIRCUIT FOR SIGNAL LIGHTS AND METHOD

FIELD OF THE INVENTION

The present invention generally relates to signal lights and, more particularly to signal lights including light emitting diodes.

BACKGROUND OF THE INVENTION

Flashing, i.e., intermittently or periodically illuminated, lights have long been used to provide visual warnings, and a considerable body of research has been compiled in the fields of physiology, psychology and engineering concerning human perception of flashing light (i.e. the ability of people to perceive and respond to flashing light). This field of study involves the study of psycho-visual or psycho-optical sensory phenomena.

It is known in the art that certain factors may be applied to the provision of a flashing warning light for improving the visibility of a flashing light, that is, for making a flashing light visible at a greater distance, and for enhancing the probability that people will not only see the flashing light, but will also react consciously to it.

For example, some studies have revealed that human visual perception of flashing light appears greatest when the light is flashed at a flash rate or frequency in the range of 3 to 10 flashes per second, with a flash duration of at least 0.05 seconds. For the flashing of a light to be perceived as discrete flashes, the flash rate or frequency must be below the so-called "flicker-fusion" frequency, that is the frequency above which a flashing light appears as a steady light ("persistence of vision"), this critical frequency being considered to be approximately 24–30 flashes per second. Flash rate or frequency is often described in terms of "flashes-per-second" (fps).

Different flashing lights are known for providing visual alert or warning lights, and have employed incandescent lamps, rare gas discharge lamps and, more recently, light emitting diodes as illumination means, with some associated control circuitry. However, each of these prior art illumination means has had its disadvantages. In particular, prior art flashing light devices have not provided effective light output with low power consumption (i.e. high efficiency) at desirable high flash rates, and could not do so without severely sacrificing device power consumption and reliability of the light source. Thus a problem in the prior art has been the inability to provide a reliable warning light having high brilliance with low power operation, and that is suitable for use in portable lightweight battery powered equipment.

For example, incandescent light sources have commonly been used in flashing warning lights. However, they often are not able to come to full brightness and to then cool off to extinction (i.e. turn on and off) within the higher optimum flash rate frequencies for attracting attention. Also, the flashing character of typical tungsten-filament lamps is degraded significantly above flash rates of about 9 fps. Furthermore, because of the inherent thermal inertia of incandescent light sources (once turned sufficiently on to emit light, there is a significant delay in extinction to the off state), such light sources cannot provide flashes of relatively short duration, nor can such light sources provide adequate on-off contrast when operated at higher flash rates. In addition, an incandescent flashing light with adequate intensity for outdoor use usually requires larger size batteries to compensate for the excessive power loss in the form of heat, thus rendering it impractical for applications requiring reasonably small size and light weight necessary for portability. As a consequence, incandescent light sources are not suitable for use as warning lights at those flash rates and flash duration periods to which human visual perception is most sensitive but are constrained to use at lower frequencies and longer flash periods.

An alternative in the prior art has been rare gas discharge lamps, e. g., Xenon or Argon flash tube lamps and strobes. While such devices are capable of operation at higher flash rates they are also limited to extremely short flash durations which cannot be lengthened. Thus, such rare gas discharge light sources are incapable of longer flash duty cycle operation. Furthermore, rare gas discharge lamps are relatively expensive and must necessarily be energized with high voltages and currents, and thus flashing warning lights of this type require complex charging and discharging circuits and consume considerable power. In addition, a large amount of energy is required to produce the flashing action of a rare-gas lamp; thus tending to deplete ordinary batteries quickly if flashed at an optimal frequency of 3 to 12 Hz continuously such as that required by a warning light. As a consequence of these drawbacks, rare gas discharge light sources for extended flashing time are only feasible where a large power source is available, such as the utility power, or a power generator, but not in a portable application.

Light-emitting diodes (LED's) are well known semiconductor devices in which an electrical current is passed through a diode junction and produces light emission in an active layer of semiconductor material at the junction. At least one facet of the device is coated with an anti-reflective material, through which light is emitted. Ordinary LED's are relatively durable mechanically and electrically and, heretofore have most readily lent themselves to low voltage-low current operation and electronic control for both flash rate frequency and duration. However such ordinary LED's as have previously been used as light sources in flashing warning lights were of insufficiently low light intensity output. Hence the use of such low luminosity light emitting sources in visual warning devices has been of limited effectiveness, being restricted to subdued light environments such as for indoor activities, or where the ambient or background light level is quite low so that sufficient contrast can be obtained with the relatively dim illumination intensity of ordinary LED's to render them visible against a background. Thus, ordinary LED flashers have found wide application in toys, jewelry and traffic directional systems where visibility requirements are not critical.

One example may be found in U.S. Pat. No. 5,313,187, issued to Choi et al., where a one or more superluminescent light emitting diodes (SLEDS) are driven with an oscillatory square wave pulse drive signal varying between zero and about three $V_{DC}$ at a frequency between one Hz to twelve Hz, and having a pulse duty cycle between 5% to 10%. This arrangement periodically forward biases the SLED's into illumination, thus producing a brilliant rapidly flashing light. A low frequency oscillator stage is provided to generate an oscillatory square wave voltage signal $V_o$ which drives a power driver stage to produce the correspondingly oscillating drive voltage signal $V_d$ which is supplied to the SLED's. Significantly, the frequency and duty cycle of the drive pulse signal $V_d$ are chosen to produce enhanced SLED illumination brightness and to operate the SLED within its most efficient operating characteristics. An exemplary circuit is provided that utilizes an astable monovibrator employing two transistors operated in the saturation mode with positive feedback as the low frequency oscillator, and a third transistor that is driven as a saturated switch by the oscillator output $V_o$. This acts as a power driver stage to switch battery current supplied to the SLED's as the drive voltage $V_d$ for flashing the SLED's on and off at the frequency and pulse duty cycle of $V_o$. The pulse on time and off time and thus the flash frequency and duty cycle are determined by RC time constants of feedback circuits in the oscillator stage.

Prior art devices, while adequate for their intended purpose, suffer from the common deficiencies associated with flashing light devices. In order to be both effective and practical, a portable warning light should satisfy several requirements. It must provide adequate visibility and attention-getting luminous intensity as well as, adequate on-off contrast ratio of the light source, flash rate/frequency, and flash duration/period. It should be highly controllable, providing relative ease of control of the light source for effective flash rate frequency and flash duration. It should be driven by a systems that offers extended operating battery life, which requires balancing the interdependent factors of power available, light output intensity, and permissible weight of the device. It should also be light weight, small size, and capable of being retrofit into existing signaling and warning equipment currently in the field.

Thus, it remains desirable to provide a battery-powered flashing safety warning light which is simple and economical to manufacture and which is able to deliver effective illumination levels with high on-off contrast for high visibility and attention-getting performance while still providing long battery life.

SUMMARY OF THE INVENTION

The present invention provides a burst pulse illumination circuit for over-driving a superluminescent light emitting diode having a maximum forward continuous current rating. A power supply provides a pulse width modulated signal to an analog memory connected to the power supply and a pulse generator. The pulse generator includes a window comparator engaged with the analog memory, and is responsive to a portion of the pulse width modulated signal. A power driver that is controlled by the output of the pulse generator is operably connected with the superluminescent light emitting diode and with the power supply so as to energize the superluminescent light emitting diode with a current that is above the maximum forward continuous current rating by between two and ten times its maximum rated continuous current.

In another embodiment of the invention, a signal, such as a traffic directional or cautionary signal, e.g., a flashing speed limit, directional arrows, or verbal cues, i.e., "slow-down", "turn right", "detour," is provided including one or more arrays of flashing lights. Each array of lights is arranged in electrical communication with a power supply that provides a pulse width modulated signal to drive the flashing of the arrays. Each light comprises a plurality of light emitting diodes having a first color and a first brightness wherein each of the flashing lights includes at least one superluminescent light emitting diode having a maximum forward continuous current rating, a second color, and a second brightness. An analog memory is connected to the power supply and is responsive to a portion of the pulse width signal driving the arrays of lights. A pulse generator comprising a window comparator is responsive to the analog memory and a portion of the pulse width modulated signal. A power driver, that is controlled by the output of the pulse generator, is operably connected with the superluminescent light emitting diode and the power supply. In this way, the superluminescent light emitting diode is energized with at least five times its maximum forward continuous current rating.

A method for creating a bright strobed light is also provided comprising over-driving at least one superluminescent light emitting diode having a maximum forward continuous current rating, into forward biased conduction with a current of at least five times the maximum forward continuous current rating for a predetermined time period.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
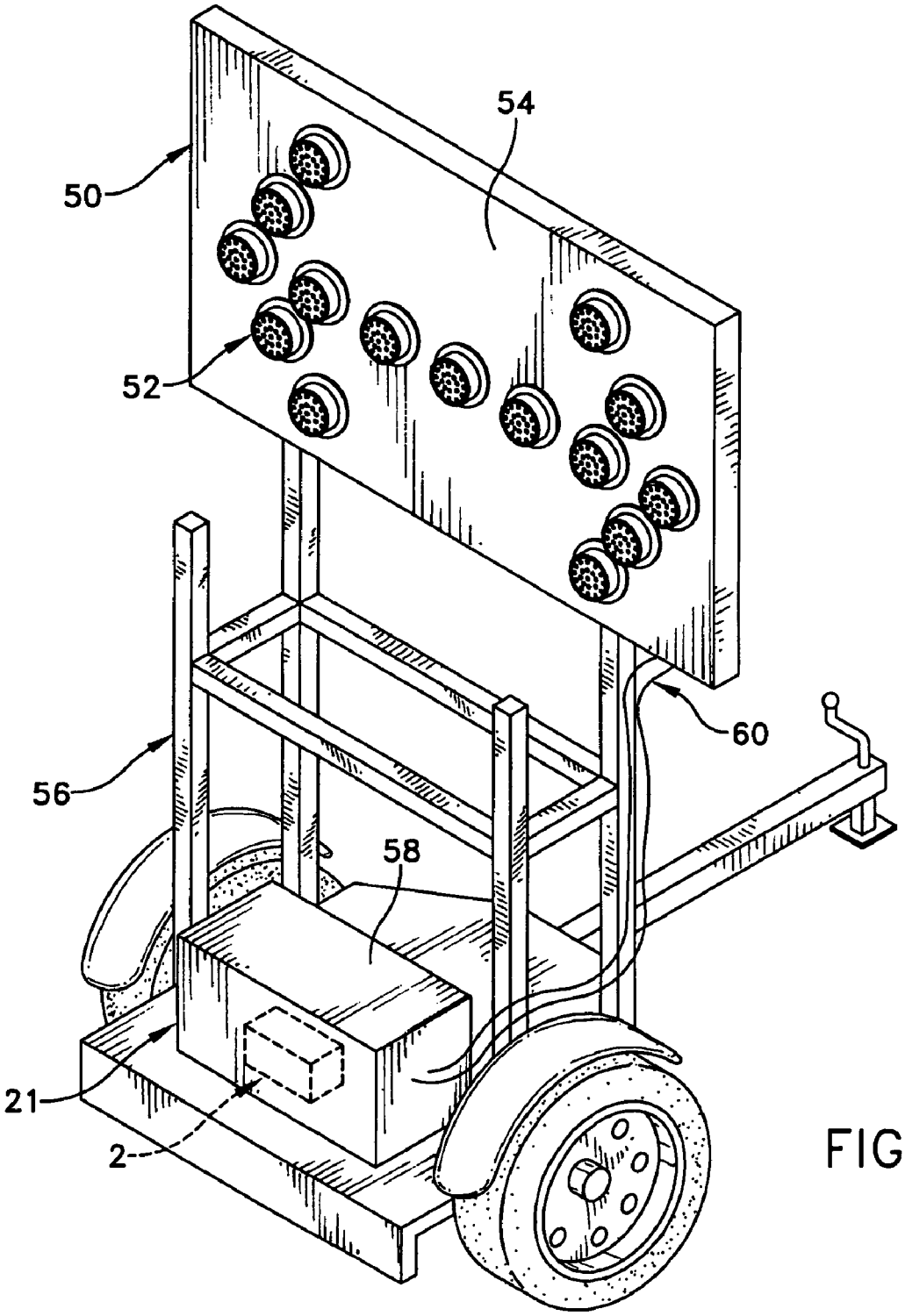
FIG. 1 is a perspective view of a flashing signal of the type used in connection with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. Terms concerning attachments, coupling and the like, such as "connected" and "interconnected," refer to a relationship wherein structures, circuits, or circuit elements are electrically or mechanically secured or attached to one another either directly or indirectly through intervening structures, unless expressly described otherwise. The term "level" refers to a reference voltage or current that may or may not have a zero magnitude. In the claims, means-plus-function clauses are intended to cover the structures described, suggested, or rendered obvious by the written description or drawings for performing the recited function, including not only structural equivalents but also equivalent structures.

Figure 2:
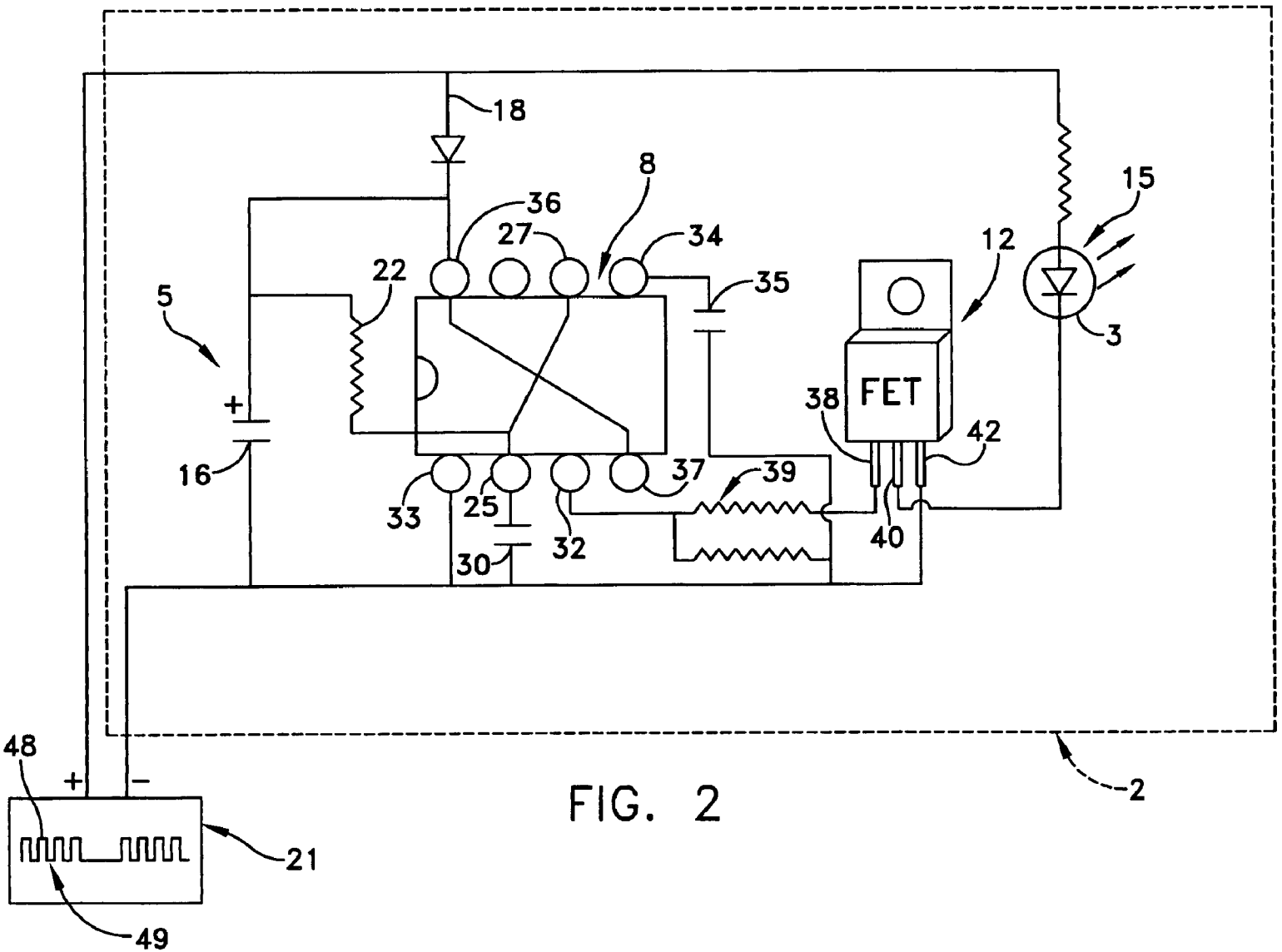
FIG. 2 is a schematic diagram of one embodiment of the burst pulse circuit of the present invention.

Referring to FIGS. 1 and 2, the present invention provides a burst pulse illumination circuit 2 that may be used in combination with a super-luminescent LED 3 arranged within an array of flashing LED's 4 so as to provide shortened response time and reaction time to, e.g., motor vehicle operators. It is customary in the art to utilize amber or yellow colored LED's for flashing LED's 4. The super-luminescent LED's used in combination with the present invention are often white, but may be other colors as well.

Burst pulse circuit 2 comprises an analog memory circuit 5, a pulse generator 8, a power driver 12, and a solid state light source 15, i.e., one or more super-luminescent LED's 3, that are operatively engaged with one another to produce a super-bright light output over a relatively short period of time. More particularly, analog memory circuit 5 often comprises a capacitor 16 and a diode 18 arranged in series. In one arrangement of analog memory circuit 5, diode 18 has it's anode electrically connected to the positive terminal of an adjoining circuit or a power supply 21. Typically, power supply 21 provides a Pulse Width Modulated (PWM) current wave form of the type that is well known in the art. For example, power supply 21 may provide a two Hz square wave having a fifty percent duty cycle, that is pulse width modulated at a frequency of one kilohertz on its positive portion. When capacitor 16 is charged, via applying a current wave form to diode 18, it acts as a current "memory" device for pulse generator 8, as will hereinafter be disclosed in further detail. A first terminal lead of a resistor 22 is electrically connected to the junction between capacitor 16 and diode 18.

Pulse generator 8 often comprises a one-shot timer circuit arranged as a window comparator, e.g., an SE555/NE555 timer chip with its trigger pin 25 electrically connected to its threshold pin 27 (FIG. 2). Of course, an LMC555 timer chip that is based upon CMOS technology, such as the one manufactured by National Semiconductor, may be used in connection with the present invention with adequate results. The second terminal lead of resistor 22 is interconnected between analog memory circuit 5 and trigger pin 25 and threshold pin 27. A timing capacitor 30 is also electrically connected to trigger pin 25 and threshold pin 27. In this way, the values of resistor 22 and timing capacitor 30 determine the "off-on" time interval for output pulses from output pin 32. It will be understood that in this arrangement, trigger pin 25 and threshold pin 27 are 180 degrees out of phase with output pin 32. Also in this arrangement, pin 33 is set at a reference level, as is pin 34 although via capacitor 35. Pin 36 ($V_+$) and pin 37 (reset) are electrically connected to the junction of capacitor 16 and diode 18 so as to set $V_{cc}$ for pulse generator 8.

Power driver 12 typically comprises a field effect transistor or the like, having three terminals, a first terminal 38 that is interconnected with output pin 32, via a resistive circuit 39; a second terminal 40 that is interconnected with the cathode of solid state light source 15, and a third terminal 42 that is interconnected with power supply 21. Power driver 12 should be sized appropriately for "over-driving" solid state light source 15 (e.g., white super-luminescent LED 3). It should be understood that the terms "over-drive," "over-driven," or "over-driving" when used in connection with the present invention mean the application of at least two to ten times the manufacturer's recommended average continuous current for solid state light source 15, and preferably at least five times that rated continuous current. For example, when using a super-luminescent light emitting diode (SLED) having an absolute maximum forward continuous current rating, at twenty-five ° C., of thirty milliamperes, and a pulse forward current rating of seventy milliamperes, i.e., a peak forward continuous current (1/10 duty cycle at 1 kHz); "over-drive," "over-driven," or "over-driving" within the present invention comprises operating that SLED at over two (2) times, and preferably five (5) or more times the normally rated continuous current. A solid state light source 15 that has been found to be effective when used in connection with the present invention is white LED model No. 383-2UWC/CB, manufactured by Everlight Electronics Co., Ltd.

When a PWM signal from power supply 21 engages analog memory circuit 5, pulse generator 8 is caused to trigger power driver 12 to "over-drive" solid state light source 15 for a predetermined period of time, e.g., approximately twenty-five to thirty milliseconds. The "over-driving" of solid state light source 15 causes a super-bright pulse of light to be emitted for a limited period of time, thus causing LED 3 to function as a strobed light having a brightness that is at least two times the magnitude of the brightness of each LED 4. In practice, burst pulse circuit 2 is able to over-drive LED 3 to obtain between four thousand and ten thousand millicandellas of illumination over a twenty-five to thirty millisecond time period. This closely approximates the illumination available from conventional Xenon flash lamps, and greatly exceeds the illumination from conventional LED's.

Figure 9:
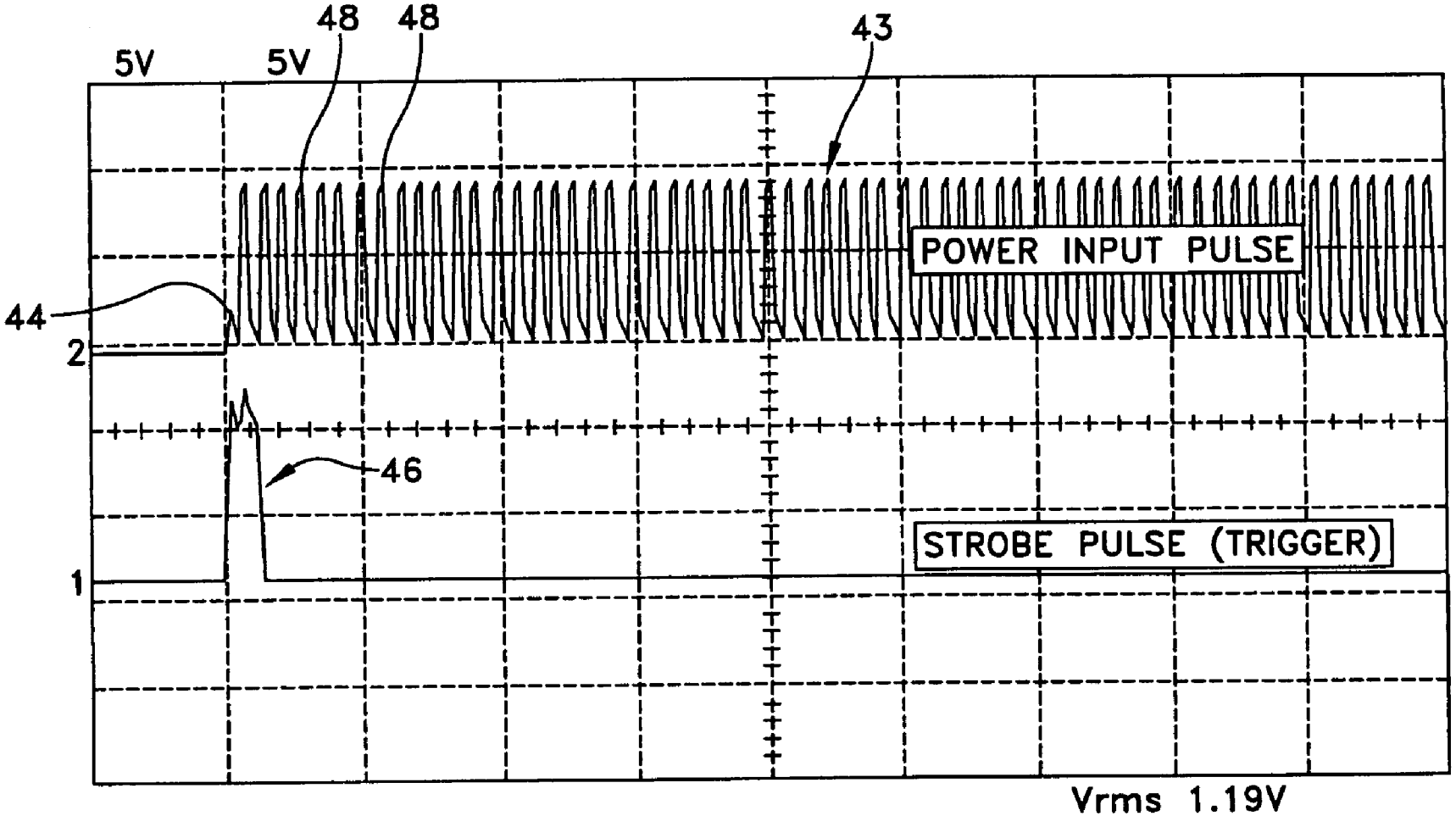
FIG. 9 is a graphical representation illustrating a pulse width modulated power input pulse and the strobe pulse that is triggered by the leading edge of the PWM signal.

Burst pulse circuit 2 operates in the following manner. An incoming PWM signal 43 (FIG. 9) that is arranged and timed to periodically energize array of LED's 4 within their recommended current values, is applied across capacitor 16 and diode 18, thus charging capacitor 16 and establishing $V_{cc}$ at pin 36 to a constant level. As this occurs, the leading positive edge 44 of first power pulse 43 also charges timing capacitor 30 through resistor 22, not instantaneously, but over a predetermined period of time, e.g., about twenty-five to thirty milliseconds. The charging of timing capacitor 30 raises the voltage at trigger pin 25 and threshold pin 27, causing pulse generator 8 to output a single "over-drive" pulse 46 having a duration determined by the R-C time constant of timing capacitor 30 and resistor 22.

The duration of the "off-on" time is determined by the R-C time constant that is associated with the particular combination of timing capacitor 30 and resistor 22. For example, in one embodiment of the present invention, resistor 22 may be selected to have a value of about two-hundred and twenty thousand ohms and timing capacitor 30 may be selected to have a capacitance of about one microfarad, thus yielding an "on" or "burst pulse" time interval of about twenty-five milliseconds. In this arrangement, capacitor 16 has a value of about fifty microfarads (when using an SE555/NE555 timer, but one microfarad for an LMC555 CMOS chip) yielding a memory time on the order of fourteen milliseconds, i.e., about twice the period of PWM signal 43.

Thus, a single "over-drive" pulse 46 is applied to solid state light source 15, e.g., super-luminescent LED 3, for each "on" duty cycle of array of LED's 4. Analog memory circuit 5 operates by diode 18 also rapidly charging capacitor 16 which maintains the voltage at control pin 36 at $V_{cc}$ for a time period greater than the pulse width modulated frequency of the power signal, e.g., about twice the time period of PWM signal 43. Capacitor 16 stores this charge during subsequent short duty cycle pulses 48 of the PWM signal, thus maintaining control pin 36 at $V_{cc}$ for this predetermined time. As a result, pulse generator 8 produces one "over-drive" pulse 46 for each "on" power cycle 49 of power supply 21, regardless of the duty cycle of the power modulation.

Burst pulse circuit 2 may be utilized in several applications to significant advantage. For example, a warning signal board 50 for use as a traffic directional or cautionary signal may embody, or be retrofitted with, burst pulse circuit 2 so as to include one or more white super-luminescent LED's 3 in its array of amber LED's 4. More particularly, warning signal board 50 often comprises an array of signal lights 52 each comprising an ordered array of LED's 4. Signal lights 52 are arranged on a back panel 54 that may be mounted on a suitable stand 56, or to the back of a vehicle (not shown). Power supply 21 may take the form of a control system 58 that is arranged in electrical control communication with array of signal lights 52 so as to provide a predetermined set of PWM signals to signal lights 52 so as to provide numeric information, e.g., speed limits, directional arrows, or verbal cues, e.g., "slow-down", "turn right", "detour," etc. Burst pulse circuit 2 may be incorporated within a portion of warning signal board 50 or control system 58 by electrically engaging the signal lines 60 running from control system 58 (power supply 21) to signal board 50. It should be understood that burst pulse circuit 2 requires only a single input line and single output line (e.g., two wires) thus being fully compatible and retrofittable with existing signal board electronic systems.

Figure 3:
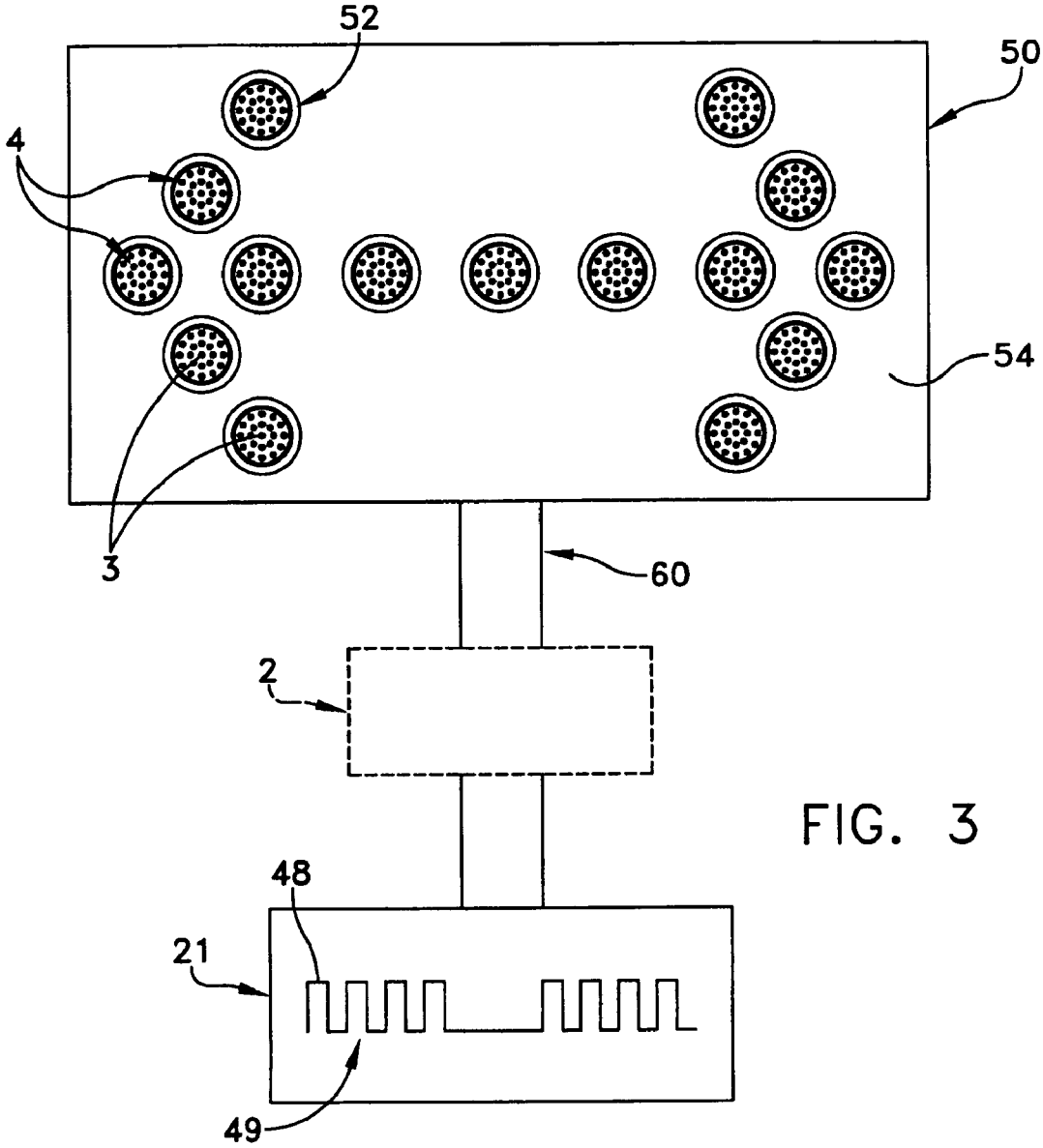
FIG. 3 is a front elevational view of a flashing signal board, partially in schematic form, to illustrate one embodiment of a bright strobe light arranged in accordance with the present invention.
Figure 4:
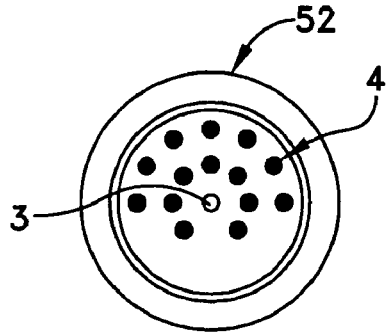
FIG. 4 is a front elevational view of one of the array of flashing lights shown in FIG. 3, showing one possible arrangement of bright strobe light in accordance with the present invention.
Figure 5:
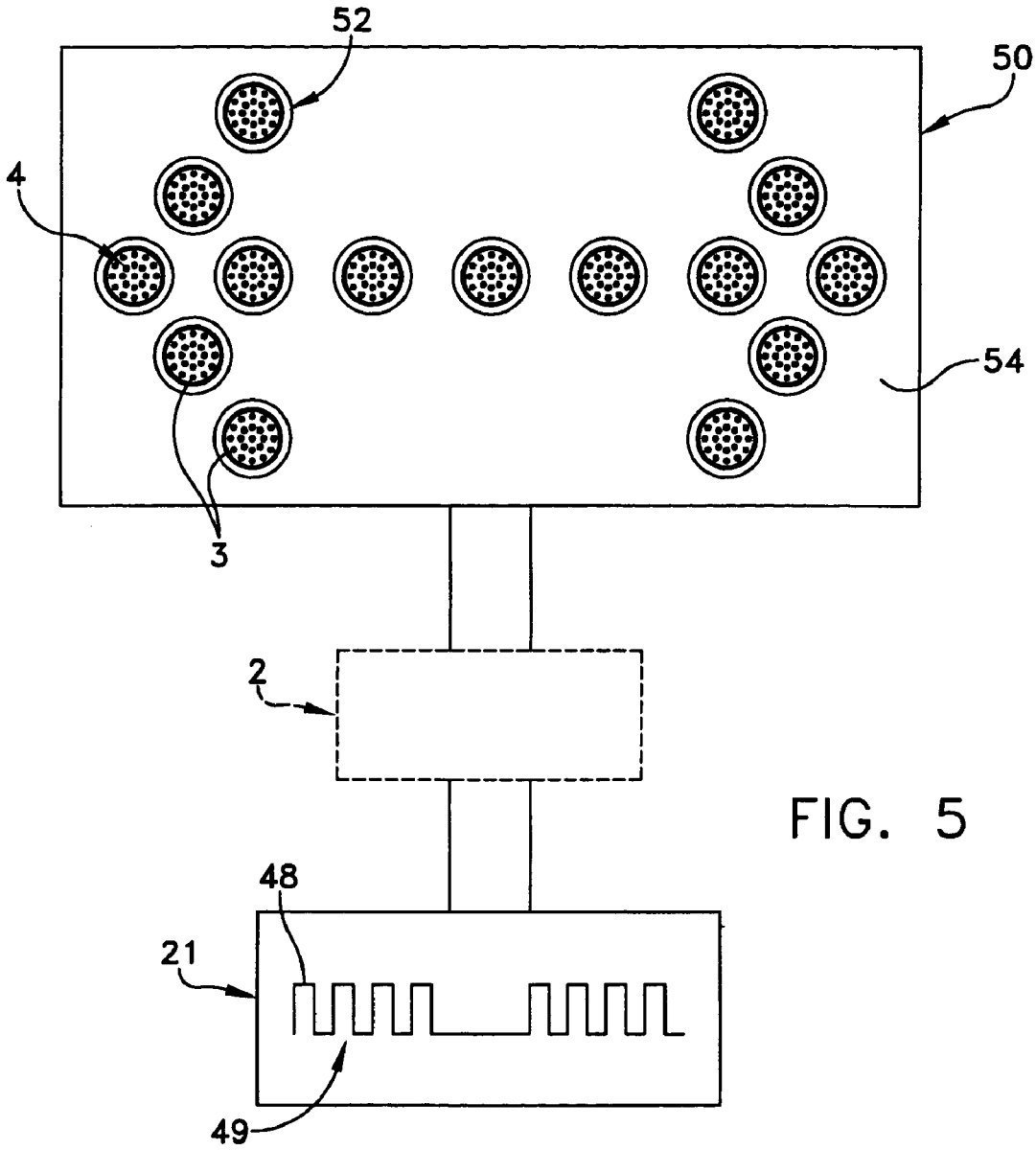
FIG. 5 is a front elevational view of a flashing signal board, partially in schematic form, to illustrate another embodiment of bright strobe lights arranged in accordance with the present invention.
Figure 6:
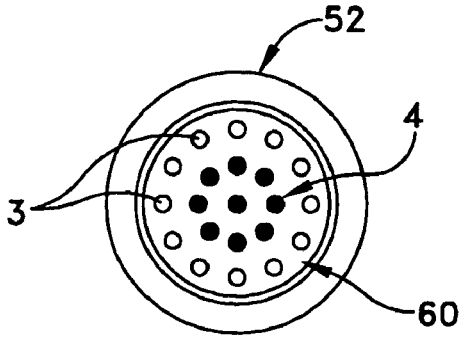
FIG. 6 is a front elevational view of one of the array of flashing lights shown in FIG. 5, showing another possible arrangement of bright strobe lights in accordance with the present invention.
Figure 7:
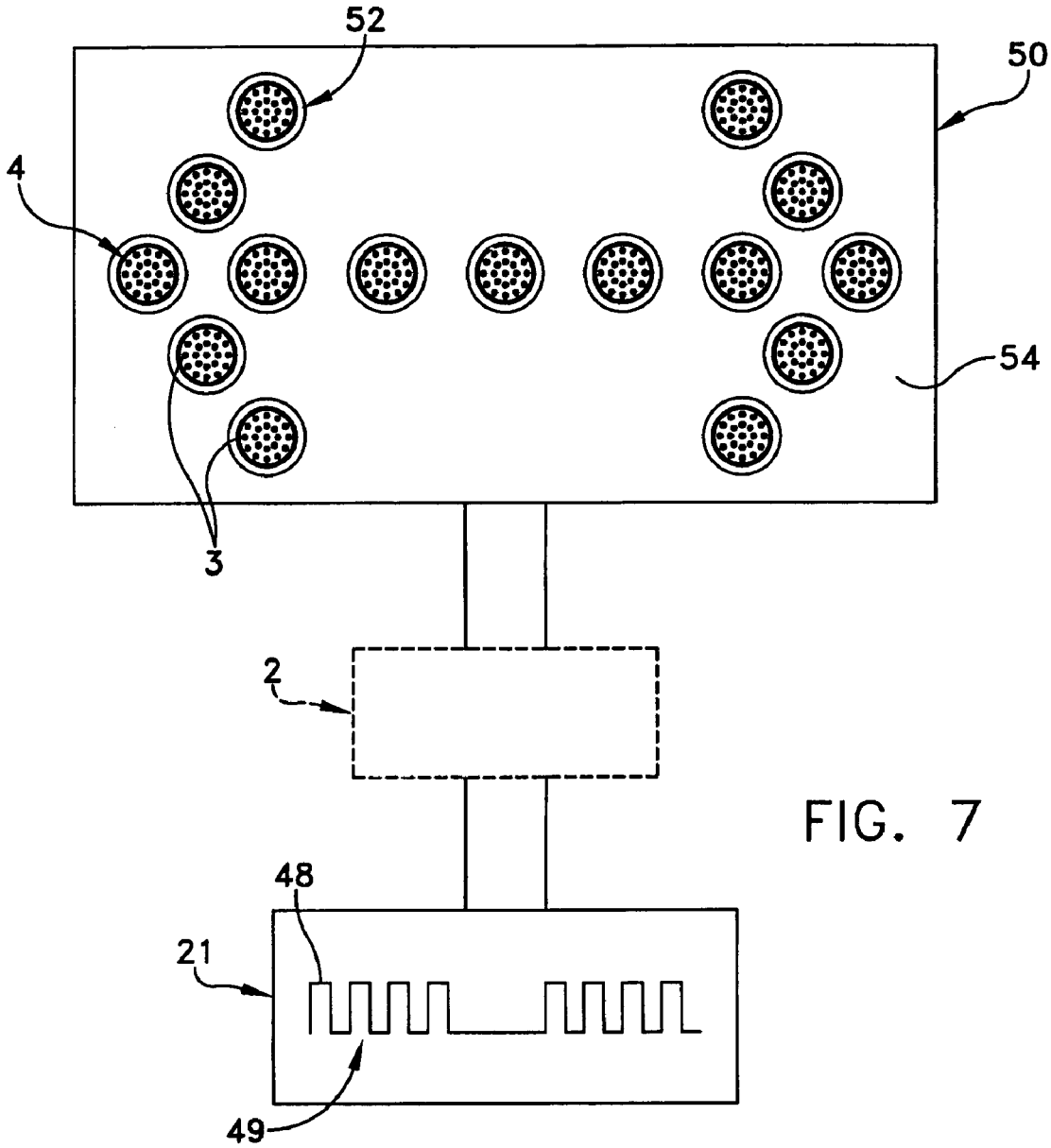
FIG. 7 is a front elevational view of a flashing signal board, partially in schematic form, to illustrate a further embodiment of bright strobe lights arranged in accordance with the present invention.
Figure 8:
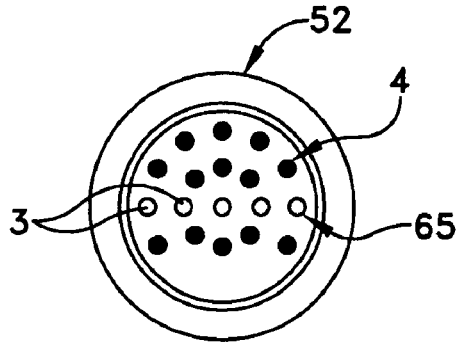
FIG. 8 is a front elevational view of one of the array of flashing lights shown in FIG. 7, showing a further possible arrangement of bright strobe lights in accordance with the present invention.

Referring to FIGS. 3–8, an array of LED's 4 within each signal light 52 may comprise any number of over-driven "solid state light sources 15, i.e., any number of white LED's" 3, so as to provide a wide variety of strobed white lights embedded in each array of amber LED's 4. For example, a single over-driven super-luminescent LED 3 may be placed at the center of LED array 4, and caused to strobe, via burst pulse circuit 2, either in phase or out of phase with the flashing cycle for LED's 4 (FIGS. 3 and 4). Alternately, a circle 64 of over-driven super-luminescent LED's 3 may be arranged so as to surround LED's 4, providing yet another warning arrangement (FIGS. 5 and 6). Also, a horizontal, vertical, or diagonal line (identified generally by reference numeral 65 in FIG. 8) of over-driven super-luminescent LED's 3 may be arranged within the array of amber LED's 4 as well.

It is a common requirement in signal boards 50 that are used in evening or nighttime traffic environments to be required to dim the luminosity of the flashing lights in order to avoid causing "night-blindness" in drivers. This dimming is very often effected by lengthening the pulse width in PWM signal 43 driving array of LED's 4. Advantageously, since PWM signal 43 also drives solid state light source 15 (White LED 3) burst pulse circuit 2 will correspondingly dim LED 3, along with array of LED's 4 in correlation with the corresponding change in pulse width from power source 21. PWM signal 43 exists across white LED 3, so as the pulse width changes, i.e., as the duty cycle of each pulse is adjusted to implement the dimming of the overall light system, over-driven white LED 3 will correspondingly dim.

Figure 10:
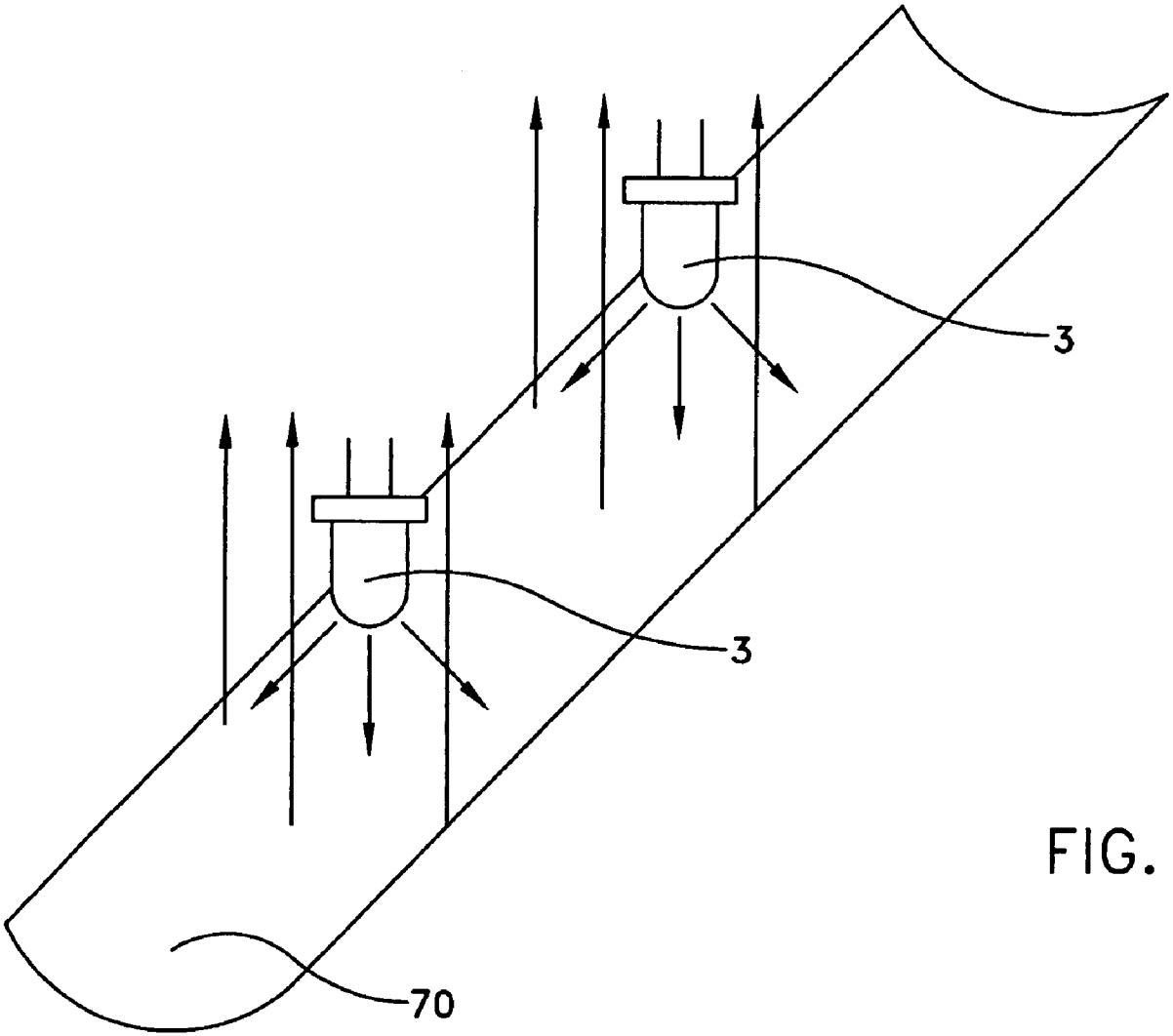
FIG. 10 is a schematic representation of an arrangement of bright strobe lights driven in accordance with the present invention including a reflector.
Figure 11:
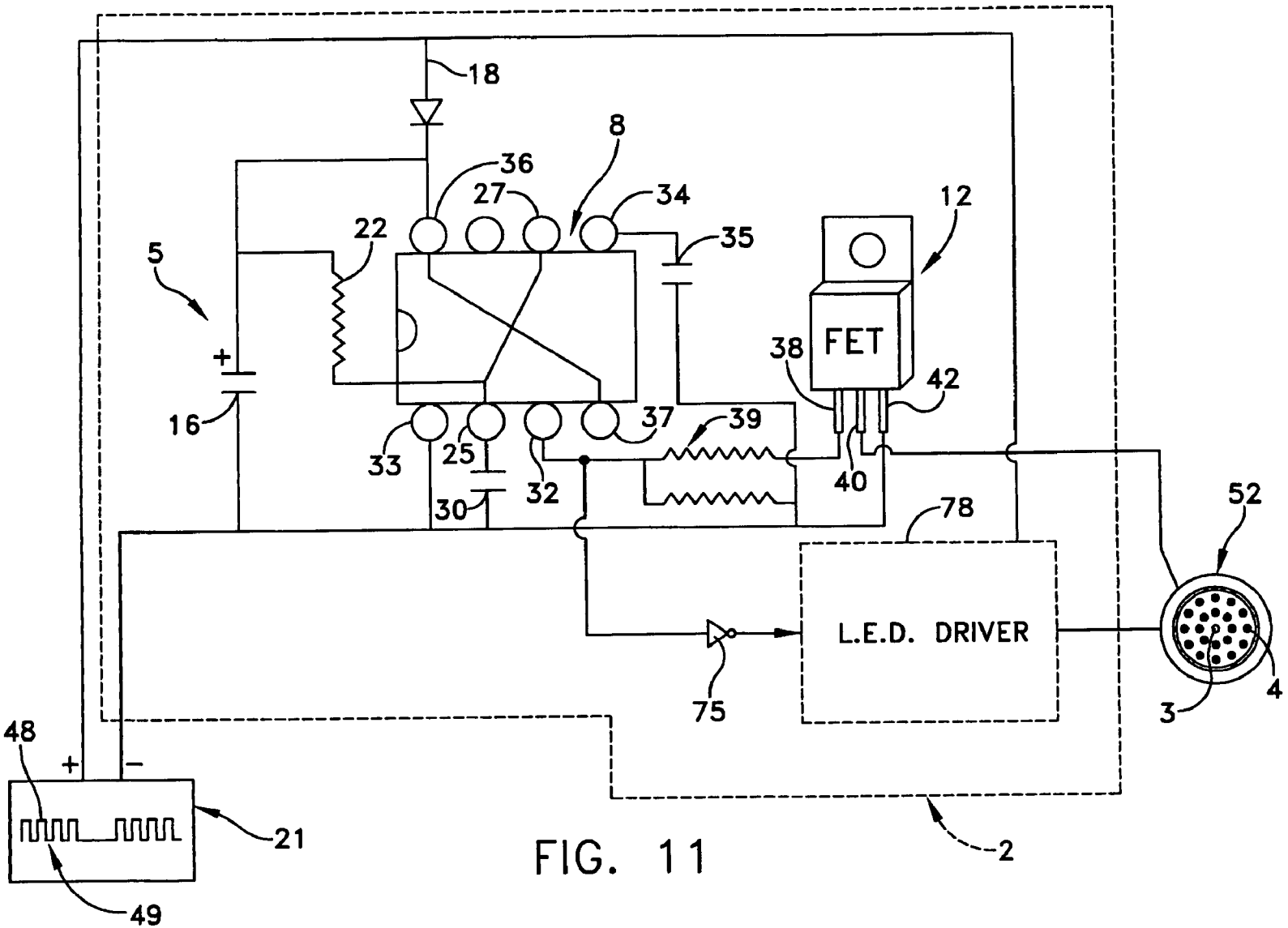
FIG. 11 is a schematic diagram of another embodiment of the burst pulse circuit of the present invention.
Figure 12:
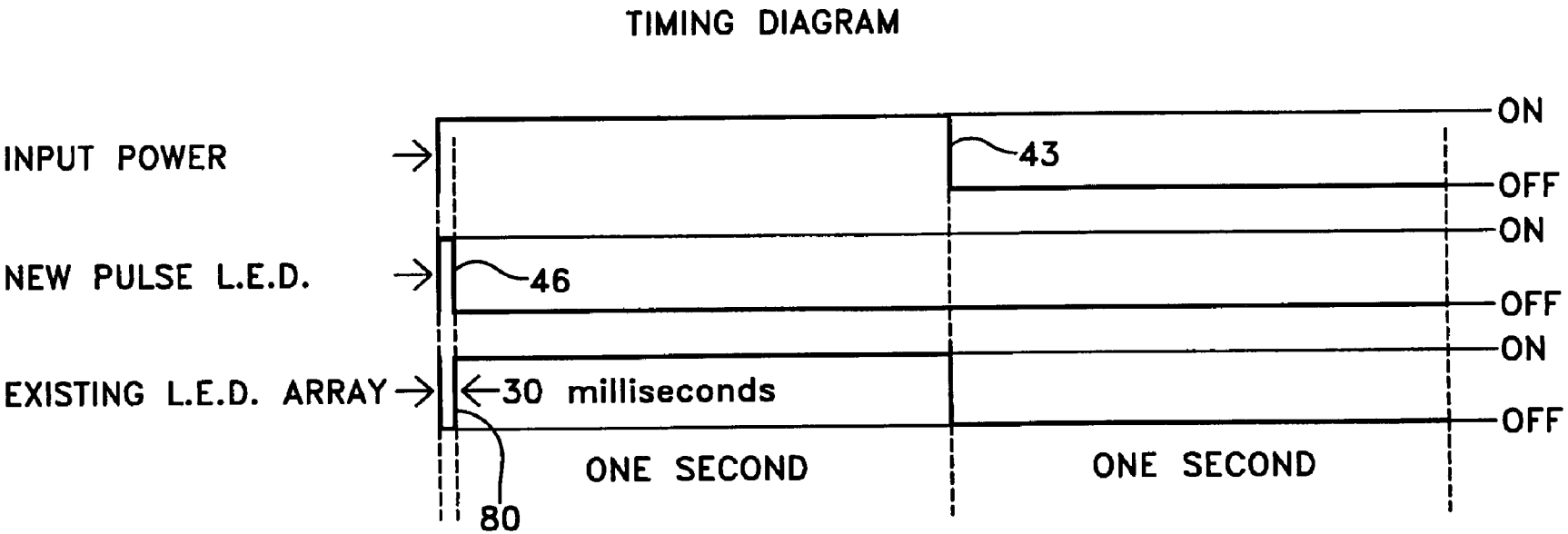
FIG. 12 is a timing diagram representing the sequential timing for the driving of LED's with the alternative embodiment of the present invention shown in FIG. 11.

Burst pulse circuit 2 may also find application in a variety of vehicle applications, such as school buses, ambulances, emergency, police, and military lighting applications. In addition, a reflector may be arranged in combination with one or more over-driven white LED's 3 so as to either diffuse or focus the light output (FIG. 10). In some embodiments, a parabolic reflector 70 may be used with good effect.

In another embodiment of the present invention, an inverter 75 is arranged in the electrical path of PWM signal 43 as it travels to the driver circuitry 78 that drives with array of LED's 4 so as to delay their illumination cycle by a time that is sufficient to allow for a complete "on-off" cycle of over-driven white LED's 3. In this way, when "over-drive" pulse 46 activates burst pulse circuit 2 in accordance with the present invention, a suppression pulse 80 is generated by inverter 75 to suppress illumination of array of LED's 4 during the over driven operation of white LED's 3.

ADVANTAGES OF THE INVENTION

Numerous advantages are obtained by employing the present invention.

More specifically, signaling lights and a burst pulse circuit for stroboscopically operating one or more of such signal lights are provided which avoid many of the aforementioned problems associated with prior art signal light devices and circuits.

In addition, signaling lights and a burst pulse circuit for stroboscopically operating one or more of such signal lights are provided which comprise all solid state components that are fully compatible with existing equipment and power sources in the field for easy retrofitting.

Furthermore, signaling lights and a burst pulse circuit for stroboscopically operating one or more of such signal lights are provided which lower power drain from the use of solid state LED's, but at the same time are capable of operation at significantly brighter, but controllable light levels and variable flash rates.

Also, signaling lights and a burst pulse circuit for stroboscopically operating one or more of such signal lights are provided which require no high voltage capacitor, thus making the circuit simpler, smaller, less expensive, and more reliable.

Additionally, signaling lights and a burst pulse circuit for stroboscopically operating one or more of such signal lights are provided which eliminates recharge time required for start of a next flash pulse, allowing instantaneous cycle times for fast flash cycles, and infinitely adjustable flash duration times, i.e., dimming capability.

Furthermore, signaling lights and a burst pulse circuit for stroboscopically operating one or more of such signal lights are provided which require no high voltage as in typical xenon tube strobes, promoting safety, reducing circuit complexity, increasing reliability, and decreasing manufacturing costs.

It is to be understood that the present invention is by no means limited only to the particular constructions, methods of operation, and arrangements herein disclosed and shown in the drawings, but also comprises any modifications or equivalents within the scope of the claims.

What is claimed is:

1. A circuit for over-driving a light emitting diode comprising:

at least one super-luminescent light emitting diode having a maximum forward continuous current rating;

a power supply that provides a pulse width modulated signal;

an analog memory connected to said power supply;

a pulse generator comprising a window comparator engaged with said analog memory and responsive to a portion of said pulse width modulated signal; and a power driver controlled by the output of said pulse generator and operably connected with said at least one super-luminescent light emitting diode and with said power supply so as to over-drive said at least one super-luminescent light emitting diode with a current having a magnitude above said maximum forward continuous current rating.

2. A circuit according to claim 1 wherein said magnitude is between two and ten times said maximum forward continuous current rating of said at least one super-luminescent light emitting diode.

3. A circuit according to claim 1 wherein said analog memory comprises means for storing a portion of said pulse width modulated signal.

4. A circuit according to claim 1 wherein said analog memory comprises a diode and a capacitor.

5. A circuit according to claim 1 wherein said pulse generator comprises means for generating a pulse.

6. A circuit according to claim 1 wherein said pulse generator includes a one-shot timer having a trigger pin electrically connected to a threshold pin.

7. A circuit according to claim 6 wherein a resistor is electrically connected between said analog memory said trigger pin.

8. A circuit according to claim 7 wherein said a capacitor is electrically connected between said trigger pin, said threshold pin, and a reference level.

9. A circuit according to claim 8 wherein the values of said resistor and said capacitor determine an "off-on" time interval for output pulses from said pulse generator.

10. A circuit according to claim 8 wherein said trigger pin and said threshold pin are held high relative to a reference by a capacitor after initial charging of said capacitor.

11. A circuit according to claim 8 wherein said power driver comprises a field effect transistor.

12. A circuit according to claim 8 wherein said power driver over-drives said at least one super-luminescent light emitting diode for a period of time less than the pulse frequency of said pulse width modulated signal.

13. A circuit according to claim 1 wherein said super-luminescent light emitting diode comprises an absolute maximum forward continuous current rating, at twenty-five °C., of thirty milliamperes, and a pulse forward current rating of seventy milliamperes.

14. A circuit according to claim 1 wherein said super-luminescent light emitting diode comprises an absolute maximum forward continuous current rating, at twenty-five ° C., of twenty milliamperes.

15. A circuit according to claim 1 including a plurality of light-emitting diodes driven by driver means operably engaged with said power supply, and an inverter responsive to said portion of said pulse width modulated signal so as to suppress operation of said driver means for a period of time less than the pulse frequency of said pulse width modulated signal.

16. A circuit for over-driving a light emitting diode comprising:

at least one super-luminescent light emitting diode having a maximum forward continuous current rating;

a power supply that provides a pulse width modulated signal;

an analog memory connected to said power supply;

a window comparator engaged with said analog memory and responsive to a portion of said pulse width modulated signal; and a power driver controlled by the output of said window comparator and operably connected with said at least one super-luminescent light emitting diode and with said power supply such that when said pulse width modulated signal encounters said analog memory circuit, said window comparator is caused to trigger said power driver to over-drive said at least one super-luminescent light emitting diode for approximately twenty-five to thirty milliseconds so as to create a super-bright pulse of light to be emitted.

17. A circuit for over-driving a light emitting diode comprising:

at least one super-luminescent light emitting diode having a maximum forward continuous current rating;

a power supply that provides a pulse width modulated signal;

an analog memory connected to said power supply;

a pulse generator engaged with said analog memory and responsive to a portion of said pulse width modulated signal; and a power driver controlled by the output of said pulse generator and operably connected with said at least one super-luminescent light emitting diode and with said power supply so as to over-drive said at least one super-luminescent light emitting diode with a current that is at least two times said maximum forward continuous current rating.

18. A circuit for over-driving a light emitting diode comprising:

at least one super-luminescent light emitting diode having a maximum forward continuous current rating;

a power supply that provides a pulse width modulated signal;

an analog memory connected to said power supply;

a pulse generator comprising a window comparator engaged with said analog memory and responsive to a portion of said pulse width modulated signal; and a power driver controlled by the output of said pulse generator and operably connected with said at least one super-luminescent light emitting diode and with said power supply so as to over-drive said at least one super-luminescent light emitting diode with a current that is between two and ten times said maximum forward continuous current rating.

19. A circuit comprising:

a power supply that provides a pulse width modulated signal;

an array of flashing lights arranged in electrical communication with said pulse width signal, each light comprising a plurality of light emitting diodes having a first color and a first brightness wherein each of said flashing lights includes at least one super-luminescent light emitting diode having a maximum forward continuous current rating, a second color, and a second brightness;

an analog memory connected to said power supply and responsive to a portion of said pulse width signal;

a pulse generator comprising a window comparator responsive to said analog memory and a portion of said pulse width modulated signal; and a power driver controlled by the output of said pulse generator and operably connected with said at least one super-luminescent light emitting diode and with said power supply so as to over-drive said at least one super-luminescent light emitting diode with at least five times said maximum forward continuous current rating.

20. A circuit according to claim 19, wherein said second brightness is at least two times the magnitude of said first brightness.

21. A circuit according to claim 19, wherein said over-driven super-luminescent light emitting diode yields between four thousand and ten thousand millicandellas of illumination.

22. A circuit according to claim 19 wherein said magnitude is between two and ten times said maximum forward continuous current rating of said at least one super-luminescent light emitting diode.

23. A circuit according to claim 19 wherein said analog memory comprises means for storing a portion of said pulse width modulated signal.

24. A circuit according to claim 19 wherein said analog memory comprises a diode and a capacitor.

25. A circuit according to claim 19 wherein said pulse generator comprises means for generating a pulse.

26. A circuit according to claim 19 wherein said pulse generator includes a one-shot timer having a trigger pin electrically connected to a threshold pin.

27. A circuit according to claim 26 wherein a resistor is electrically connected between said analog memory said trigger pin.

28. A circuit according to claim 27 wherein said a capacitor is electrically connected between said trigger pin, said threshold pin, and a reference level.

29. A circuit according to claim 27 wherein the values of said resistor and said capacitor determine an "off-on" time interval for output pulses from said pulse generator.

30. A circuit according to claim 27 wherein said trigger pin and said threshold pin are held high relative to a reference by a capacitor after initial charging of said capacitor.

31. A circuit according to claim 28 wherein said power driver comprises a field effect transistor.

32. A circuit according to claim 29 wherein said power driver "over-drives" said at least one superluminescent light emitting diode for a period of time less than the pulse frequency of said pulse width modulated signal.

33. A circuit according to claim 29 wherein said super-luminescent light emitting diode comprises an absolute maximum forward continuous current rating, at twenty-five ° C., of thirty milliamperes, and a pulse forward current rating of seventy milliamperes.

34. A circuit according to claim 19 wherein said super-luminescent light emitting diode comprises an absolute maximum forward continuous current rating, at twenty-five ° C., of twenty milliamperes.

35. A circuit according to claim 19 including means for driving said array of flashing lights and an inverter responsive to said portion of said pulse width modulated signal so as to suppress operation of said means for driving for a period of time less than the pulse frequency of said pulse width modulated signal.

36. A circuit comprising:

a power supply that provides a pulse width modulated signal;

an array of flashing lights arranged in electrical communication with said pulse width signal, each light comprising a plurality of light emitting diodes having a first color and a first brightness wherein each of said flashing lights includes at least one super-luminescent light emitting diode having a maximum forward continuous current rating, a second color, and a second brightness;

at least one analog memory connected to said power supply and responsive to a portion of said pulse width signal;

at least one pulse generator comprising a window comparator responsive to said at least one analog memory and a portion of said pulse width modulated signal; and at least one power driver controlled by the output of said at least one pulse generator and operably connected with said at least one super-luminescent light emitting diode and with said power supply so as to over-drive said at least one super-luminescent light emitting diode with at least five times said maximum forward continuous current rating.

* * * * *